US006378409B1

(12) United States Patent
Reid et al.

(10) Patent No.: US 6,378,409 B1
(45) Date of Patent: Apr. 30, 2002

(54) REPLACEABLE HOLE PUNCH FOR IMAGE CAPTURING DEVICES

(75) Inventors: James J. Reid; Lynn S. Gill, both of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/494,035

(22) Filed: Jan. 31, 2000

(51) Int. Cl.[7] ..... B06D 1/56; B26F 1/14; B65B 61/00

(52) U.S. Cl. ..... 83/347; 83/108; 83/117; 83/139; 83/344; 83/686; 83/689; 83/659; 83/103; 83/25; 83/304; 270/58.07

(58) Field of Search ..... 83/108, 139, 323, 83/339, 344, 347, 348, 434, 436.9, 594, 669, 670, 620, 304, 623, 117, 686, 688, 689, 346, 684, 685, 659, 660, 103, 25, 667, 695, 678, 430; 270/58.07

(56) References Cited

U.S. PATENT DOCUMENTS 2,729,028 A * 1/1956 Slayter et al. ..... 83/347 X
2,951,410 A * 9/1960 Brown ..... 83/304
3,118,336 A * 1/1964 Hampshire ..... 83/347
4,248,114 A * 2/1981 Alexander et al. ..... 83/347
4,289,055 A * 9/1981 Von Schriltz ..... 83/659
4,406,196 A * 9/1983 Roncato et al. ..... 83/117
5,092,207 A * 3/1992 Kikuchi et al. ..... 83/116
5,451,288 A * 9/1995 Smith et al. ..... 156/359
5,533,431 A * 7/1996 Schickling ..... 83/347
5,842,401 A * 12/1998 Hart ..... 83/698.51
5,911,414 A * 6/1999 Kato et al. ..... 270/58.07

* cited by examiner

*Primary Examiner*—Boyer Ashley
(74) *Attorney, Agent, or Firm*—Oliff & Berridge PLC

(57) ABSTRACT

A three hole punch system is for use in an image capturing device. The three hole punch system uses elastomeric rollers that punch holes in the edge of a sheet as it passes between two rollers. If desired, the rollers can act as a transport for the sheet without punching holes in the sheet. After the holes are punched, the resultant slugs are pushed back into the holes and the sheet is retrieved by the operator.

7 Claims, 4 Drawing Sheets

REPLACEABLE HOLE PUNCH FOR IMAGE CAPTURING DEVICES

BACKGROUND OF THE INVENTION

1. Field of Invention

This invention is directed towards hole punch systems and mechanisms in image capturing devices.

2. Description of Related Art

Image forming devices input information from an original image to generate data representing the original image. A copy of original image is transferred to paper or other media. After the copy image has been fixed to the paper, other processes such as stapling, bundling and/or hole punching are applied.

SUMMARY OF THE INVENTION

During the operation of copiers and other image forming devices, a copy of an original image is transferred to paper or other media. During this process the paper is fed through the image forming device using rollers. The rollers allow the paper to be transferred from one operation of the image forming device to another operation and ultimately out the image forming device to be retrieved by the operator. As the paper travels from one operation to another operation, several optional functions can be performed on the paper before it is retrieved by the operator.

This invention provides image forming devices and methods that perform a hole punch operation on the paper.

This invention separately provides image forming devices and methods that allow the operator to remove or replace a hole punch subsystem.

This invention separately provides image forming devices and methods that manage the paper slugs that are left over after punching holes in the paper.

This invention separately provides image forming devices and methods that have the ability to turn the hole punch operation on or off.

In various exemplary embodiments of the image forming devices and methods according to this invention, the hole punch device is contained within the paper rollers of the image capturing apparatus. Two opposite rollers are made of different density elastomeric materials, such as rubber or polyurethane. The punch device is contained in the less-dense roller.

In various exemplary embodiments of the image forming devices and methods according to this invention, the punched holes are one of two types, a dislodged hole type, a circular hole type and an offset dislodged hole type.

These and other features and advantages of this invention are describes in or are apparent from the following detailed description of the apparatus/system and methods according to this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
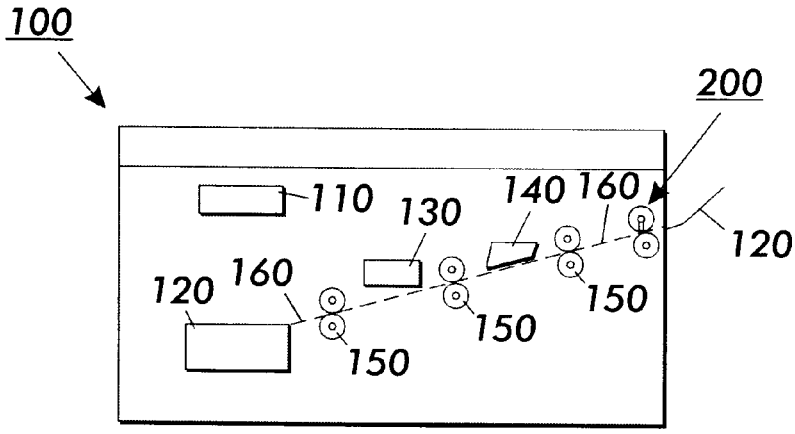
FIG. 1 illustrates an image forming device according to this invention.

FIG. 1 shows one exemplary embodiment of an image forming device 100 that includes an image transferring device 110 and a hole punch device according to this invention. The image transferring devices 110 contain one or more of a light source, mirrors and image sensing devices that are used to form a latent image of an original image and to transfer the latent image of the original image onto a sheet of recording medium 160. The sheet 160 is supplied from a tray 120. The sheet 160 onto which the latent image is formed is then fed through the image forming device by a number of sets of rollers 150. The sheet 160 is fed through an image forming engine 130 that forms a developed toner image on the sheet 160. The toner image is then fixed to the sheet 160 by a toner fixing device 140. The sheet 160 is then fed to a paper receiving tray 170 by a set of hole punch rollers 200. The hole punch rollers 200 can be used to punch holes at the edge of sheet 160 so that the sheet 160 can be placed into, for example, a three-ring binder. If the holes in the sheet 160 are not necessary, then the hole punch rollers 200 are used as normal rollers and feed the sheet 160 to the paper receiving tray 170 without punching holes.

Figure 2:
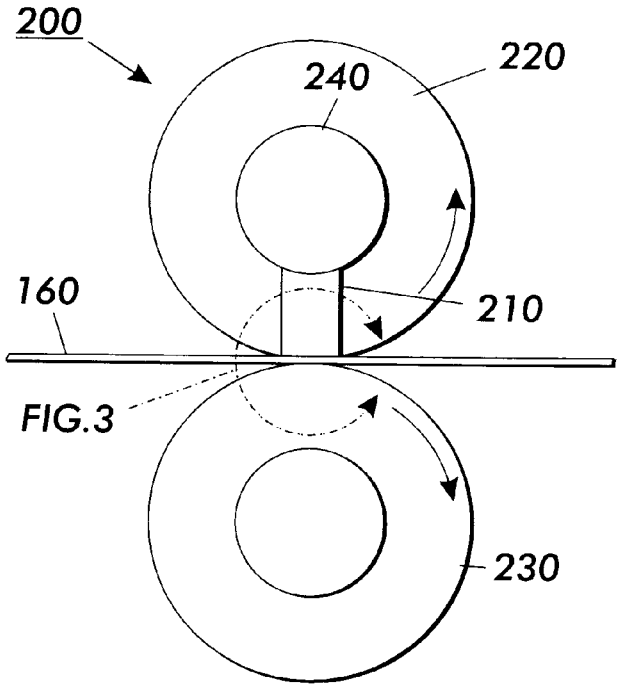
FIG. 2 illustrates the hole punch system of the image forming device of FIG. 1.

FIG. 2 shows one exemplary embodiment of the hole punch rollers 200 according to this invention. The hole punch rollers 200 include a top roller 220 and a bottom roller 230. Together, the top and bottom rollers 220 and 230 feed the sheet 160 to the paper receiving tray 170 or other sheet receiving device. The top roller 220 is made of a low density elastomeric or rubber material. The top roller 220 containing a hole punch device 210 is formed of the lower density material. It should be appreciated that, if the bottom roller 230 should instead contain the hole punch device 210, the relative densities of the elastomeric materials forming the top and bottom rollers 220 and 230 should be reversed. The hole punch device 210 is fixed to a center piece 240 of the top roller 220. The center roller piece 240 provides stability for the hole punch device 210.

The diameter of the top roller 220 is sized to the progression of the sheet 160 so that the hole punch device 210 will punch at least one set of holes in the sheet 160, where one set of the punched holes is located at the leading or trailing edge of the sheet 160, as the sheet 160 passes between the hole punch rollers 200. The rollers 220 and 230 turn to feed the sheet 160 through the top and bottom rollers 220 and 230 and to punch holes in the sheet 160.

Each time the hole punch 210 makes contact with the sheet 160, a hole is punched into the sheet 160. If the operator does not wish to have holes punched in the sheet 160, then the pressure between the rollers 220 and 230 is reduced. In particular, the pressure is not reduced so much that the top and bottom rollers 220 and 230 cannot continue to grab the sheet and feed it between the top and bottom rollers 220 and 230. However, the reduced pressure is not great enough for the hole punch 210 to punch a hole in the sheet 160. Thus, the reduced pressure allows the sheet 160 to pass through the rollers without the hole punch 210 punching holes in the sheet 160.

Similarly, the pressure between the top and bottom rollers 220 and 230 can be controlled so that a desired number of sets of holes are punched in the sheet 160 as it passes between the hole punch rollers 200, or so that the sets of punched holes are located at desired locations on the sheet 160. It should be appreciated that any known or later developed structure or mechanism capable of controllably pressing at least one of the top and bottom rollers 220 and 230 against the other roller can be used to press the rollers 220 and 230 together and to control the pressure between the top and bottom rollers 220 and 230.

Figure 3:
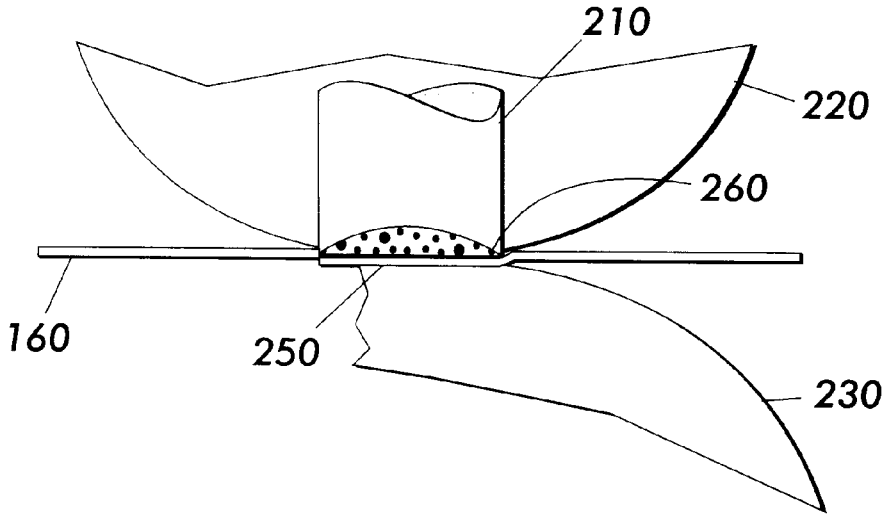
FIG. 3 illustrates the hole punch in greater detail.

FIG. 3 is a magnified view of the hole punch device 210. During the hole punch process, the sheet 160 is sandwiched between the top roller 220 and bottom roller 230. The top roller 220 is less dense than the bottom roller 230. Because of the density difference, the bottom roller 230 pushes upwards on the top roller 220. This causes the sheet 160 to be forced against the hole punch 210, punching out a slug 250 from the sheet 160. The slug 250 is the portion of the sheet 160 removed by the hole punch 210. In various exemplary embodiments, the hole punch 210 contains a nip 260 that doesn't cut through the sheet 160. This allows the slug 250 to remain attached to the sheet 160, thus eliminating the need for disposing of and managing the slugs 250. The shape of the hole can be any one of numerous shapes depending upon the shape of the hole punch 210. After the hole has been punched into the sheet 160, the sheet 160 continues along the sheet path. The slug 250 is pushed back into the hole in the sheet 160 by the force of the top and bottom rollers 220 and 230 pushing against each other. As the sheet 160 is fed out of the hole punch rollers 200, the top roller 220 continues to punch holes along the edge of the paper 160. When the paper 160 is retrieved by the operator the punched holes are not apparent until dislodged in use. Therefore, any information that is contained on the slugs 250 can be read and is not lost to dislodged slugs.

Figure 4:
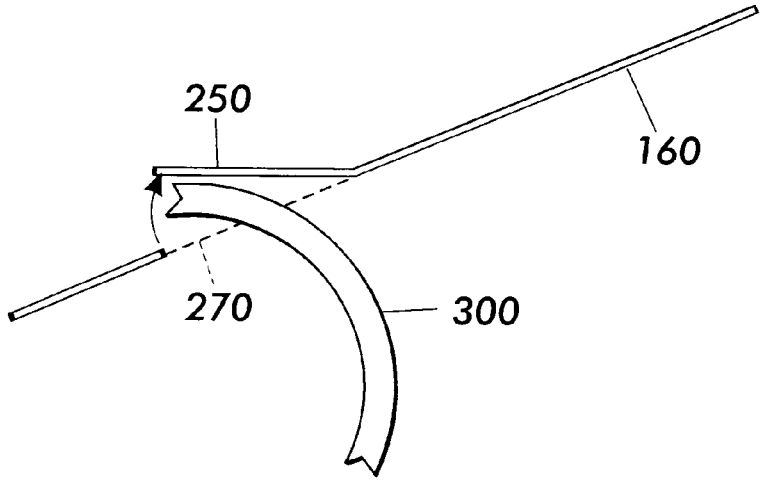
FIG. 4 illustrates the punched holes in use.

FIG. 4 is an example of how the punched hole 270 and slug 250 function. The sheet 160 contains a slug 250 that is partially attached to the sheet 160. The binder ring 300 pushes on the slug 250 revealing the punched hole 270. The slug 250 is bent in the direction that the binder ring 300 is pushing. The binder ring 300 is then inserted through the sheet 160 through the punched hole 270.

Figure 5:
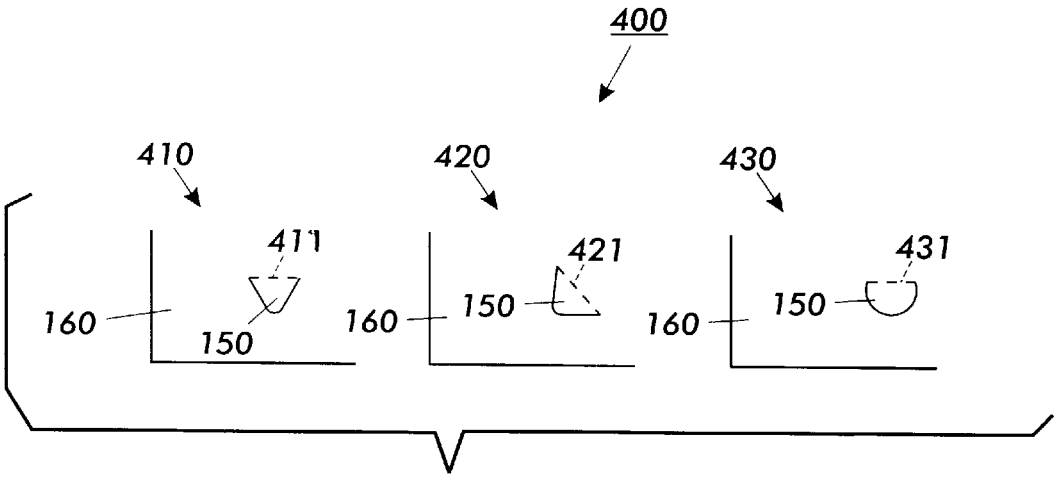
FIG. 5 illustrates a type of hole punch according to one embodiment of this invention.
Figure 6:
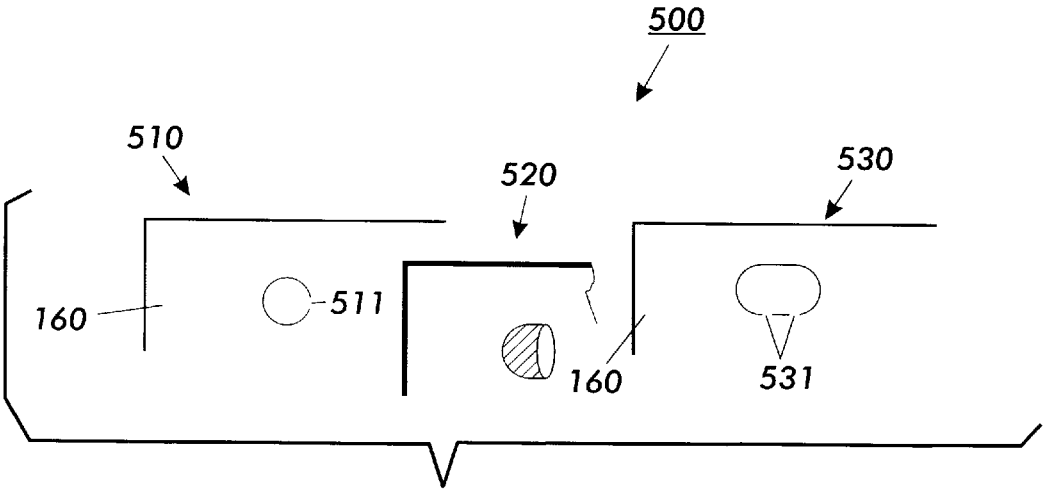
FIG. 6 illustrates another type of hole punch according to one embodiment of this invention.

FIGS. 5 and 6 are examples of various styles of holes that can be punched by the hole punch rollers 200. FIG. 5 shows a dislodged hole punch style 400. The holes punched are similar to the letter dislodged. The cuts by the hole punch 210 of dislodged hole punch style 410 are made in a triangular shape with the point facing the outer edge, of the sheet 160. The slug 150 is attached to the sheet 160 by a non-cut edge 411 shown by the hashed marks. The dislodged hole punch style 420 is the same as dislodged hole punch style 410, except that the point faces the corner of the sheet 160. The slug 250 is attached to the sheet 160 by a non-cut edge 421 shown by the hashed marks. The dislodged hole punch style 430 is U-shaped. The bottom of the U-shape faces the outer edge of the sheet 160. The slug 150 is attached to the sheet 160 by a non-cut edge 431.

FIG. 6 shows a circular hole punch style 500. The circular slug 510 is cut in a circular pattern by the hole punch 210 at the edge of the sheet 160. The circular slug 510 is attached to the sheet 160 by a non-cut segment 511. The circular slug 520 is an example of several sheets of paper that have are punched using a circular hole punch. The circular slug 530 is an example of an elongated circular hole. The circular slug 530 is attached to the sheet 160 by a number of non-cut segments 531.

Figure 7:
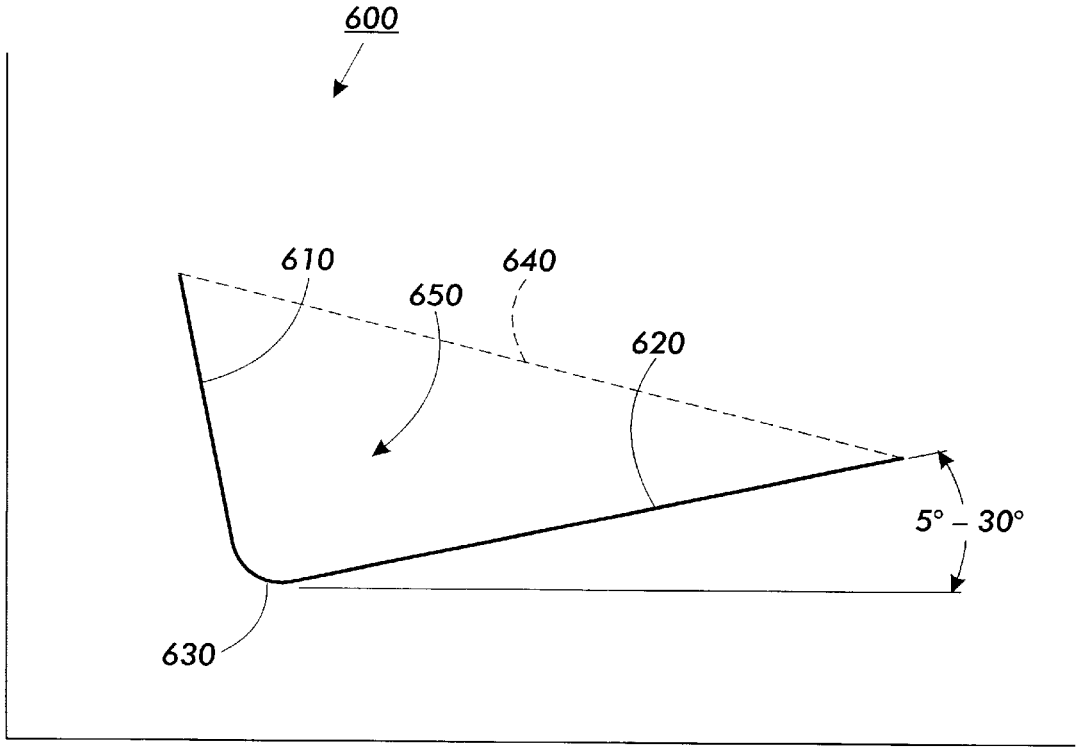
FIG. 7 illustrates another type of hole punch according to one embodiment of this invention.

FIG. 7 shows another exemplary embodiment according to this invention. FIG. 7 is an offset dislodged style 600. The offset dislodged type 600 has a short leg section 610, a long leg section 620 and a rounded edge 630 that connects the short leg section 610 and the long leg section 620 together. The offset dislodged style 600 is connected to the sheet 160 by a non-cut segment 640. The offset dislodged style 600 is shifted so that the long leg section is 5 to 30 degrees from horizontal of the edge of the sheet.

The offset dislodged style 600 provides many advantages over other punched hole designs. The flap 650 is the sheet section contained within the short leg section 610 the non-cut section 640 and the long leg section 620. The short leg section 610 provides rapid cam-down of the flap 650. The long leg section 620 provides the power to separate interlocked pages. The short leg section 610 and long leg section 620 work together to keep the flap 650 flat against the sheet 160 in the original hole it was cut from. Rotating the design by 5 to 30 degrees from the horizontal edge of the sheet 160, keeps the several sheets from interlocking and separated from each other. The offset dislodged style 600 is invisible until it is used in a binder or other sheet holding devices. Therefore, the cuts of the short leg section 610, long leg section 620 and rounded edge 630 cannot be seen. This makes it possible to read the data that may be contained in the flap 650 section of the offset dislodged style 600.

Because the cuts are simple line cuts a lower punching force can be used to make the cuts and the punch mechanism is easy to manufacture. The sheets become slug free because the flaps 650 do not need to be removed. This eliminates the need for slug disposal and the problem of slugs interlocking with other slugs. With several sheets attached in a binder the offset dislodged style 600 acts similar to a spring and helps to tighten and align the pages. This gives it the look and feel of a bound book. One key advantage of the offset dislodged style 600 is that sheets with this style of cuts can be used in a copier, printer or other image forming devices. The flap 650 is held in the cut section of the sheet 160 so that no jamming occurs as the sheets are transferred through a copier, printer or other image forming device. Thus, pre-punched paper could be used in the copier, printer or other image forming devices so that the use of the punch inside the copier or other image forming device is not necessary.

The hole punch rollers 200 can be removed and replaced when needed. When the hole punch 210 becomes dull or there are other problems that occur from usage and wear, the hole punch rollers 200 can easily be replaced by a new set of hole punch rollers 200. The hole punch rollers 200 of this invention can easily replace any rollers on existing systems. This will enable upgrading to this type of hole punch system to be easy and cost efficient.

While this invention has been described in conjunction with the exemplary embodiments outlined above, it is evident that many alternatives, modifications and variations will be apparent to those skilled in the art. Accordingly, the exemplary embodiments of the invention may be made without departing from the spirit and scope of the invention.

What is claimed is:

1. An image forming device comprising:

an image transferring device including an image forming engine that forms a developed image on a sheet;

an image fixing device that fixes the developed image on the sheet, the image fixing device operatively associated with the image transferring device;

a first roller made of a first elastomeric material;

a second roller made of a second elastomeric material wherein the first elastomeric material forming the first roller is less dense than a second elastomeric material forming the second roller, the first and second rollers placed adjacent to each other, and operatively associated with the image fixing device; and a hole punch contained within the first roller that punches holes in the sheet, wherein the hole punch includes a nip formed on one edge of the hole punch, such that the nip does not cut the sheet and a slug cut from the sheet by the hole punch remains attached to the sheet.

2. The image forming device according to claim 1, wherein the hole punch punches holes along an edge of the sheet.

3. The image forming device according to claim 1, wherein a contact pressure between the first roller and the second roller is lessened and the sheet is transported between the first roller and the second roller without the hole punch punching holes in the document.

4. The image forming device according to claim 1, wherein the first roller and the second roller are detachably positioned in the image forming device.

5. The image forming device according to claim 1, wherein a diameter of the first roller is sized to a progression of the sheet.

6. The image forming device according to claim 1, wherein the hole punch make cuts in the sheet, the cuts form an L shape, the L shape is made from a short leg section, a long leg section and a rounded edge section, the short leg section and the long leg section are connected by the rounded edge section, and the long leg section are connected by the rounded edge section.

7. The image forming device according to claim 6, wherein the L shape cut is oriented 5 degrees to 30 degrees relative to an edge of the sheet.

* * * * *